United States Patent [19]

Okuda

[11] Patent Number: 4,967,719

[45] Date of Patent: Nov. 6, 1990

[54] INTERNAL COMBUSTION ENGINE IGNITION SYSTEM

[75] Inventor: Hiroshi Okuda, Himeji, Japan

[73] Assignee: Mitsubishi Denki Kabushiki Kaisha, Tokyo, Japan

[21] Appl. No.: 437,042

[22] Filed: Nov. 15, 1989

[51] Int. Cl.[5] ..... F02P 15/02

[52] U.S. Cl. ..... 123/643; 123/149 C; 123/602

[58] Field of Search ..... 123/149 C, 415, 427, 123/602, 643

[56] References Cited

U.S. PATENT DOCUMENTS 4,170,207 10/1979 Boyama ..... 123/643
4,651,706 3/1987 Yukawa et al. ..... 123/427
4,809,661 3/1989 Kinoshita et al. ..... 123/602
4,856,488 8/1989 Okuda ..... 123/149 C

FOREIGN PATENT DOCUMENTS 51-10232 1/1976 Japan .

*Primary Examiner*—Tony M. Argenbright
*Assistant Examiner*—Robert E. Mates
*Attorney, Agent, or Firm*—Sughrue, Mion, Zinn, Macpeak and Seas

[57] ABSTRACT

An ignition timing circuit controls operational amplifiers 41, 42 associated with respective engine cylinders in accordance with relative voltage levels, V1, V2 and V3 established by resistive dividers in response to timing signals from pulse coil windings 21, 22 and the output of an operating circuit 39, thereby avoiding the use of flip flops.

1 Claim, 4 Drawing Sheets

INTERNAL COMBUSTION ENGINE IGNITION SYSTEM

BACKGROUND OF THE INVENTION

1. Field of the Invention

The present invention relates to an ignition system for a multiple cylinder internal combustion engine, wherein an ignition timing operation is carried out in a single circuit and the results of the operation is distributed to the respective cylinders.

2. Discussion of Background

FIG. 3 is a schematic circuit diagram showing a conventional internal combustion engine ignition timing control system. In FIG. 3, reference numeral 1 designates the power generation winding of a permanent-magnet generator which is driven by an internal combustion engine (not shown). The power generation winding has one end connected to the primary winding 6 of a first cylinder ignition coil 5 through a diode 2 and a thyristor 3 for the first cylinder, and to the primary winding 8 of a second cylinder ignition coil 7 through the diode 2 and a second cylinder thyristor 4. The power generation winding has the other end grounded. Reference numeral 9 designates an ignition capacitor which is connected between ground and the junction of the diode 2 and the thyristors 3 and 4. Reference numerals 10 and 11 designate the secondary windings for the first cylinder ignition coil 5 and the second cylinder ignition coil 7, respectively. The ignition coils 5 and 7 are connected to ignition plugs 12 and 13, respectively. Reference numerals 14 and 15 designate resistors which are connected between the gates and the cathodes of the thyristors 3 and 4, respectively. Reference numeral 16 designates an electrical power source which is constituted by a series combination of a diode 17, a resistor 18 and a zener diode 19 with respect to the output of the power generation winding 1, and a capacitor 20 connected in parallel with the zener diode 19.

Reference numerals 21 and 22 designate a first cylinder signal winding and second cylinder signal winding, respectively. The signal windings have their respective one ends connected to the cathodes of diodes 23 and 24, respectively. The signal windings have their respective other ends grounded. The anodes of the diodes 23 and 24 are respectively connected to the bases of transistors 29 and 30 through a CR bias network comprising a capacitor 25 and resistor 26, and through a CR bias network comprising a capacitor 27 and a resistor 28. To the bases of the transistors are connected the electrical power source through resistors 31 and 32, respectively. The collectors of the transistors 29 and 30 are connected to the power source through resistors 33 and 34, respectively. The collectors are also connected to the reset input terminals S of flip flops (hereinbelow, referred to as FF) 35 and 36. The emitters of the transistors are grounded. The set input terminal S of the FF 35 is connected to the reset input terminal R of FF 36. The set input terminal S of the FF 36 is connected to the reset input terminal R of the FF 35. The set input terminals S are connected to the input terminal of an ignition timing operating circuit 39 through diodes 37 and 38, respectively. The ignition timing operating circuit 39 has the output terminal connected to the non-inverting inputs of operational amplifiers 41 and 42 for the first and the second cylinder through a resistor 40. The operational amplifiers 41 and 42 have the inverting input terminals connected to the output terminals $\overline{Q}$ the FFs 35 and 36. The operational amplifier 41 has the output terminal connected to the gate of the thyristor 3 through a capacitor 43 and a diode 44. The operational amplifier 42 has the output terminal connected to the gate of the thyristor 4 through a capacitor 45 and a diode 46. Reference numerals 47 and 48 designate diodes, respectively, which are connected between ground and the junction of the capacitor 43 and the diode 44, and between ground and the junction of the capacitor 45 and the diode 46, respectively. Reference numeral 49 designates a resistor which is connected between ground and the non-inverting input terminals of the operational amplifiers 41 and 42.

In operation, the signal windings 21 and 22 output ignition signals shown in FIG. 4 at (a) and (b) in synchronism with the rotation of the engine. The waveshapes at points a–j in FIG. 3 are shown in FIG. 4 at (a)–(j). The transistors 29 and 30 are driven to cutoff by the ignition signals. As a result, the ignition signal by the signal winding 21 makes the FF 35 set and the FF 36 reset. The ignition signal by the signal winding 22 makes the FF 35 reset and the FF 36 set. In this way, the outputs $\overline{Q}$ of the FFs 35 and 36 form the waveshapes shown in FIG. 4 at (c) and (d), respectively. At the same time, the set signals to FFs 35 and 36 are inputted to the ignition timing operating circuit 39 through the diodes 37 and 38, respectively, as shown in FIG. 4 at (e). The ignition timing operating circuit carries out a predetermined ignition timing operation based on such inputs, outputting an ignition timing control signal for the two cylinders as shown in FIG. 4 at (f). In the period between the ignition signal of the signal winding 21 and that of the signal winging 22, the ignition timing control signal applied to the operational amplifier 41 causes the operational amplifier 41 to output a signal from its output terminal in synchronism with the ignition timing control signal because the output of the FF 35 is at a low level in that period. In the period between the ignition signal of the signal winding 22 and the ignition signal of the signal winding 21, even if the ignition timing control signal is applied to the operational amplifier 41, the operational amplifier 41 does not output the ignition signal from its output terminal. This is because the output of the FF 35 is at a high level in that period. That is to say, the ignition timing control signal for the first cylinder allows the operational amplifier 41 to output the ignition signal as shown in FIG. 4 at (g). Because the output level of the FF 36 is opposite to that of the FF 35, the output of the operational amplifier 42 becomes an ignition signal in synchronism with the ignition timing control signal for the second cylinder as shown in FIG. 4 at (h) like the operational amplifier 41 for the first cylinder. In this way, the ignition timing control signals for the two cylinders are distributed to the respective cylinders. The ignition signals which have been outputted from the operational amplifiers 41 and 42 are differentiated by the capacitors 43 and 45, respectively, to become signals as shown in FIG. 4 at (i) and (j), and the signals so obtained are applied to the gates of the thyristors 3 and 4, respectively. When the thyristors 3 and 4 are driven to conduction, the charge stored in the ignition capacitor 9 is discharged to the primary windings 6 and 8 of the ignition coils 5 and 7, thereby inducing a high voltage in the respective secondary windings 10 and 11. As a result, spark discharge is produced in the ignition plugs 12 and 13.

The conventional internal combustion engine ignition system carries out the ignition timing operation in the single ignition timing operating circuit 39 in this way, and distributes ignition timing control signals which have been outputted as the result of the ignition timing operation. There is a problem that the number of parts is great, in particular that the number of the FFs 35 and 36 should correspond to the number of cylinders to perform such distribution.

SUMMARY OF THE INVENTION

It is an object of the present invention to overcome the problem of the conventional system and to provide a new and improved internal combustion ignition system capable of decreasing the number of parts.

The foregoing and other objects of the present invention have been attained by providing an internal combustion ignition timing control system comprising ignition signal generating means for generating ignition signals to a plurality of cylinders, respectively; an ignition timing operating circuit for carrying out a predetermined ignition timing operation based on the ignition signals and delivering ignition timing control signals to the respective cylinders; a plurality of operational amplifiers arranged to correspond to the respective cylinders; first voltage setting means connected to the respective operational amplifiers, the first voltage setting means forming a first voltage signal in synchronism with the related ignition signal, and applying the first voltage signal to the inverting input terminal of the operational amplifier, the first voltage setting means forming a second voltage signal indicative of a potential lower than that of the first voltage signal at the absence of the related ignition signal, and applying the second voltage signal to the inverting input terminal; second voltage setting means connected to the respective operational amplifiers, the second voltage setting means applying to the noninverting input terminal of the operational amplifier the ignition timing signal outputted from the ignition signal timing operating circuit, the ignition timing signal being indicative of a potential higher than that of the second voltage signal, the second voltage setting means supplying the non-inverting input terminal of the operational amplifier with a third voltage signal indicative of a potential lower than that of the first voltage signal and not less than that of the second voltage signal at the absence of the ignition timing control signal; and ignition timing signal forming means connected to the respective operational amplifiers, the ignition timing signal forming means generating an ignition timing signal at the rising of the output signal from the operational amplifiers.

In accordance with the present invention, the output of the operational amplifier for each cylinder becomes a high level whenever the ignition timing control signal corresponding to the related cylinder is inputted, and forms the ignition timing signal at that time. Between that time and the time when the first voltage signal is inputted, the output of the operational amplifier remains the high level because the inequality, (the voltage indicated by the third voltage signal)≧(the voltage indicated by the second voltage signal), holds. As a result, the ignition timing signal is not produced by the ignition timing control signals for different cylinders, which are inputted in that period. After that, when the first voltage signal is inputted, the output of the operational amplifier becomes a low level, and the low level continues until the next ignition timing control signal is inputted.

In this way, the system according to the present invention is designed to carry out the distribution to each cylinder and the amplification of the ignition timing control signals, depending on the magnitude of input potential to the operational amplifiers. As a result, for example, the flip flops which are required in the conventional system can be eliminated, offering an advantage in that the number of parts can be reduced.

A more complete appreciation of the invention and many of the attendent advantages thereof will be readily obtained as the same becomes better understood by reference to the following detailed description when considered in connection with the accompanying drawings, wherein.

DESCRIPTION OF THE PREFERRED EMBODIMENTS

Figure 1:
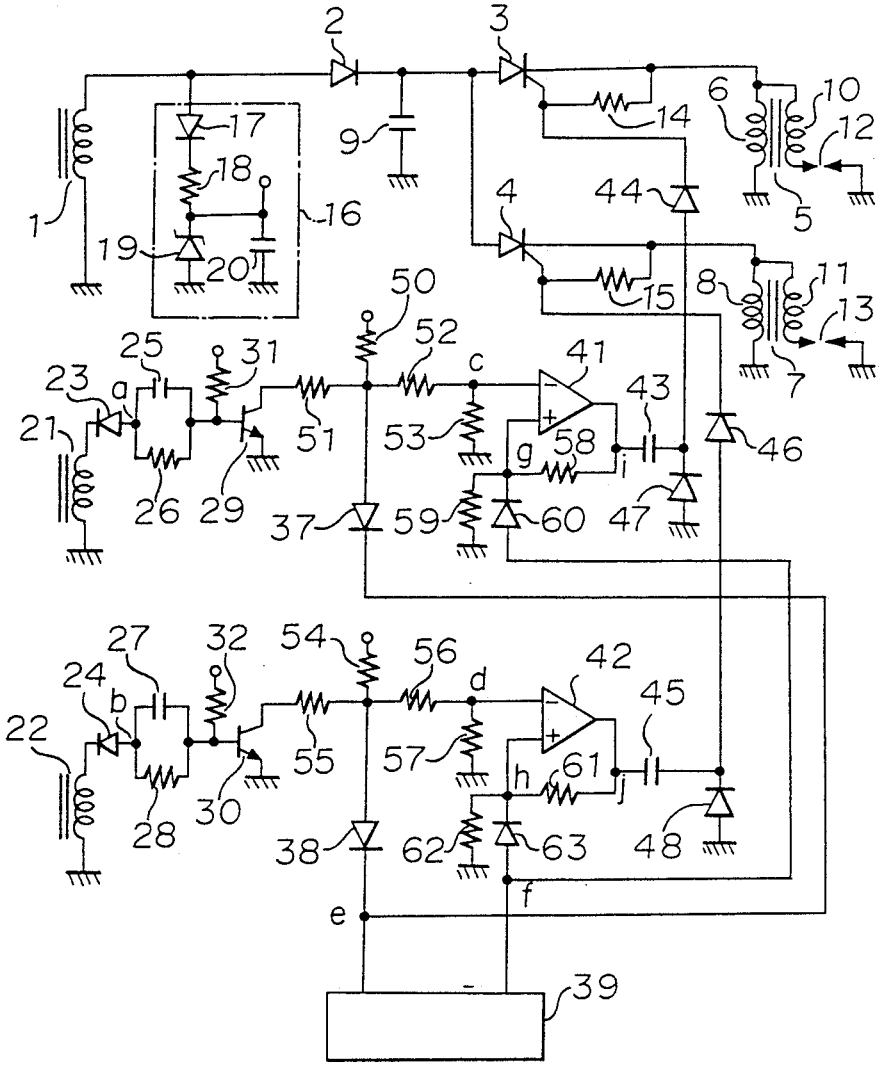
FIG. 1 is a schematic diagram of an embodiment of the internal combustion ignition system according to the present invention.

Now, the present invention will be described in detail with reference to a preferred embodiment illustrated in the accompanying drawings. FIG. 1 is a schematic circuit diagram of an embodiment of the internal combustion engine ignition system according to the present invention. In FIG. 1, parts designated as 1–48 are similar to those in the conventional system. Explanation on these parts will be omitted for the sake of clarity. Reference numerals 50–53, and 54–57 designate resistors which constitute first voltage setting means, respectively. The resistors 50 and 51 are connected in series between the collector of the transistor 29 and the power source, and the resistors 54 and 55 are connected in series between the collector of the transistor 30 and the power source. The junction of the resistors 50 and 51, and the junction of the resistors 54 and 55 are grounded through the resistors 52 and 53, and through the resistors 56 and 57, respectively. The junction of the resistors 52 and 53 is connected to the inverting input terminal of the operational amplifier 41, and the junction of the resistors 56 and 57 is connected to the inverting input terminal of the operational amplifier 42.

Reference numerals 58, 59 and 60 designate resistors and a diode, respectively, which constitute a second voltage setting means for a first cylinder and which are connected to the operational amplifier 41. The resistors 58 and 59 are connected in series between ground and the output terminal of the operational amplifier 41. The ignition timing operating circuit 39 has its output connected to the non inverting input terminal of the operational amplifier 41 through the diode 60 and the junction of the resistors 58 and 59. Reference numerals 61, 62 and 63 designate resistors and a diode, respectively, which constitute a second voltage setting means for a second cylinder and which are connected to the operational amplifier 42. The resistors 61 and 62, and the diode 63 have the same connection as the resistors 58 and 59, and the diode 60.

Figure 2:
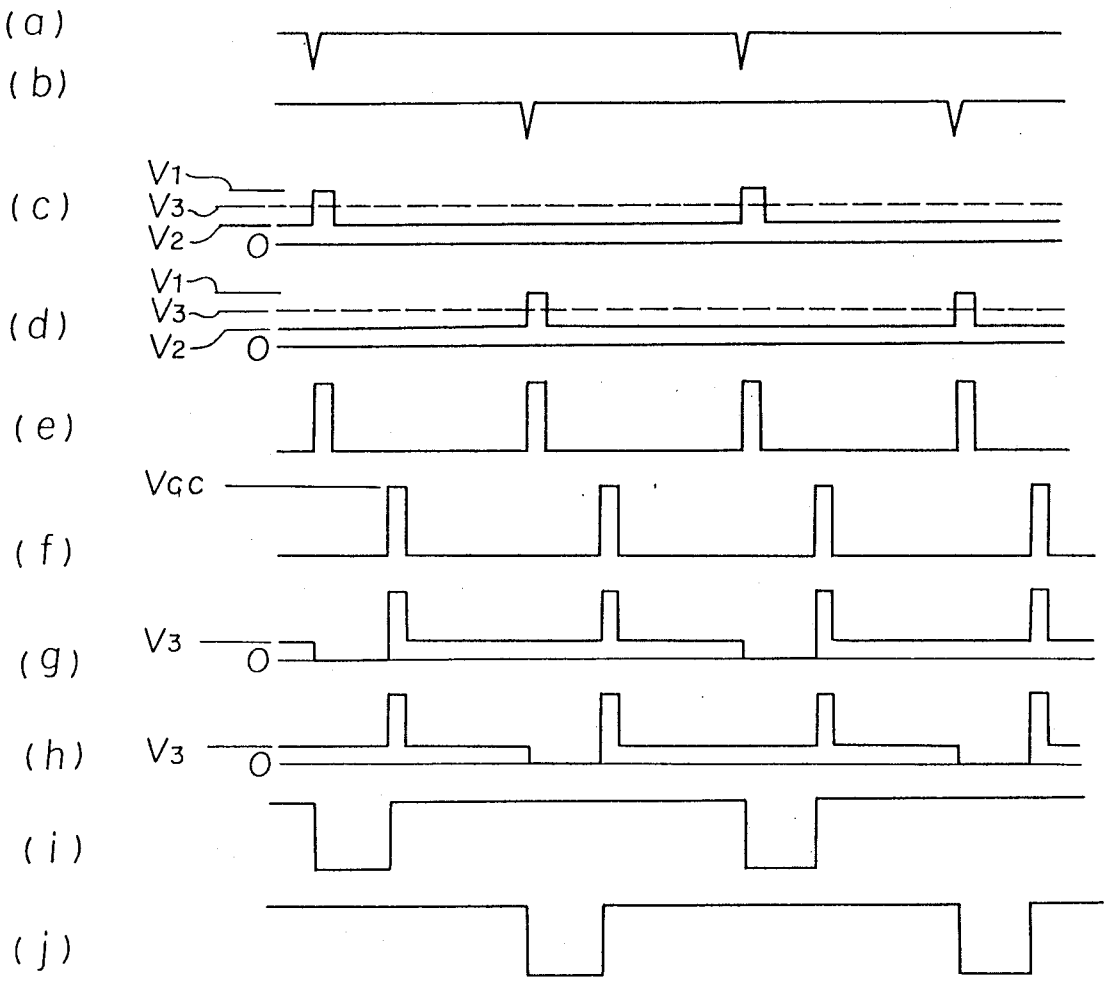
FIGS. 2(*a–j*) are a graphical representation showing the waveform at each point in the circuit of the embodiment.
Figure 3:
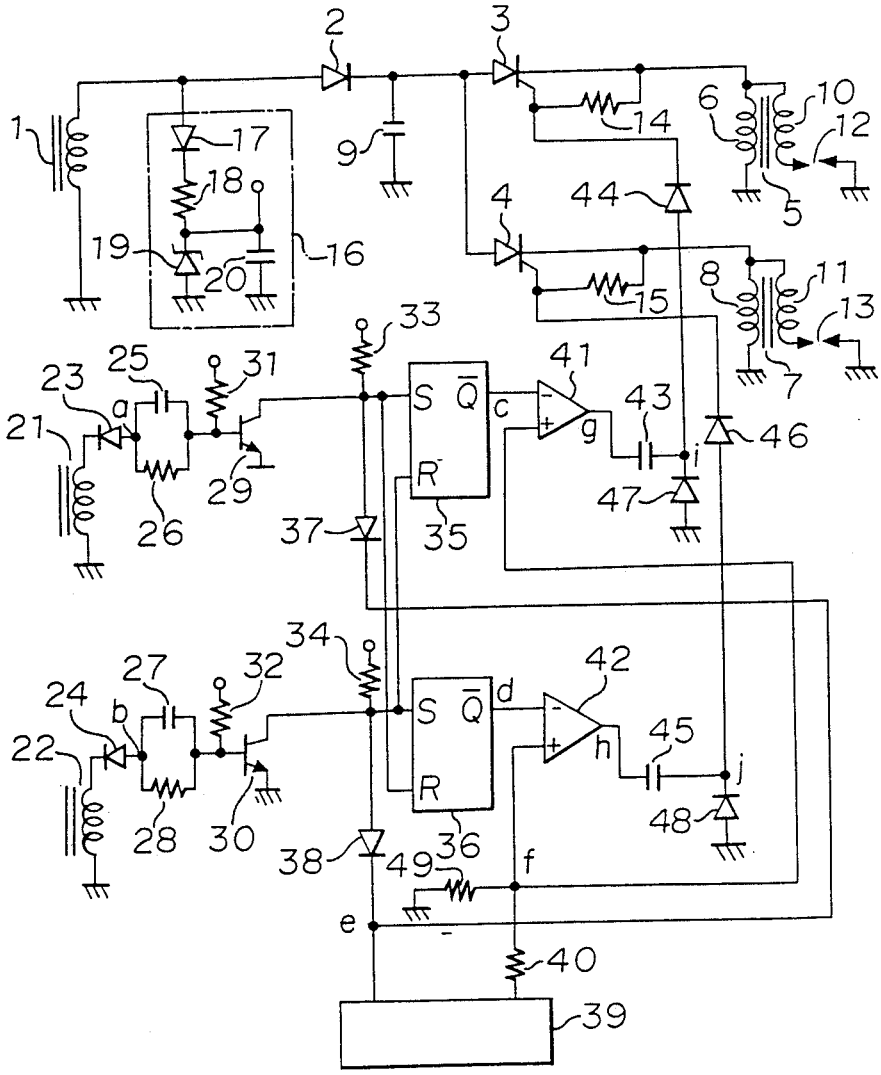
FIGURE 3 PRIOR ART
FIG. 3 is a schematic circuit diagram of a conventional internal combustion engine ignition system.
Figure 4:
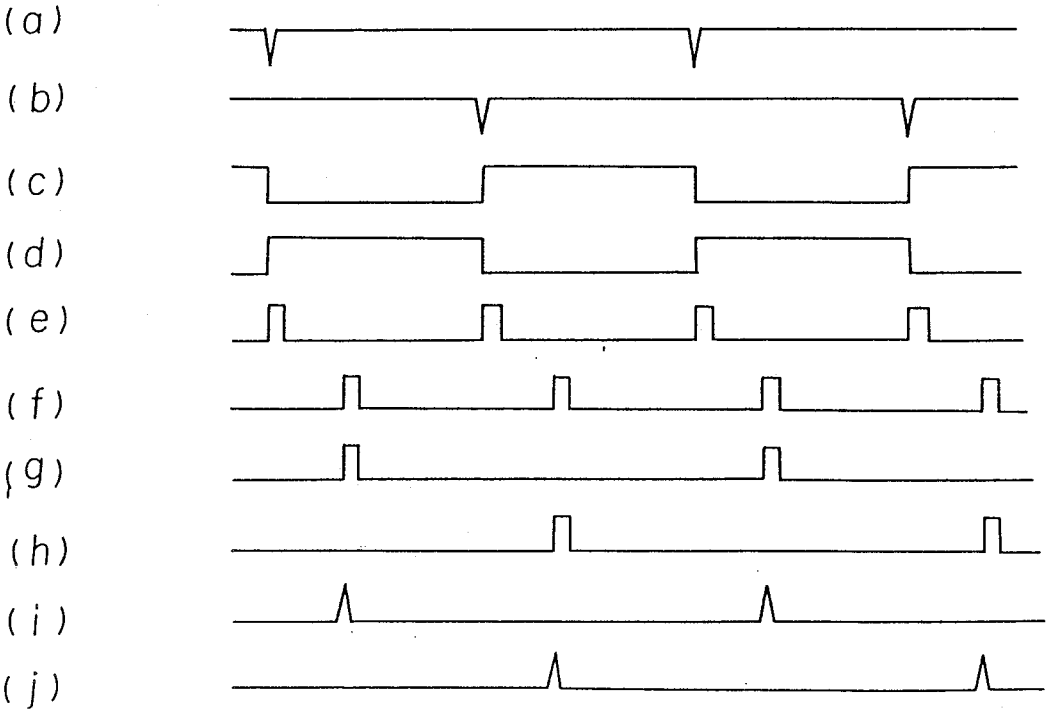
FIGURE 4 PRIOR ART
FIGS. 4(*a–j*) are a graphical representation showing the waveform at each point in the circuit of the conventional system.

Next, the operation of the internal combustion engine ignition system having the structure described above will be explained. FIG. 2 is a graphical representation showing the waveshapes at each point of the circuit, and the waveshapes at circuit points a–j in FIG. 1 are indicated in FIG. 2 at (a)–(j). When the signal windings 21 and 22 output initial side of ignition signals for the respective cylinders as shown in FIG. 2 at (a) and (b), the transistors 29 and 30 are driven to cutoff depending on the ignition signals, and the voltages at points c and d have the waveshapes as shown in FIG. 2 at (c) and (d). Specifically, in the case of the point c for the first cylinder, the presence of the ignition signal forms a first voltage signal v1 which is obtained by voltage-dividing the voltage of the power source by the combined resistance value of the resistors 50 and 52 and the resistance value of the resistor 53. The absence of the ignition signal forms a second voltage signal v2 which is obtained by voltage-dividing the voltage of the power source by the resistors 50 and 51, and by further voltage-dividing the divided voltage by the resistors 52 and 53. This is because the transistor 29 is conducting at that time. In the case of the point d for the second cylinder, the first voltage signal v1 and the second voltage signal v2 appear like the point c for the first cylinder.

The voltage signal at the voltage-dividing point of the resistors 50 and 51, and the voltage signal at the voltage-dividing point of the resistors 54 and 55 are combined to be inputted to the ignition timing operating circuit 39 as shown in FIG. 2 at (e). The ignition timing operating circuit carries out a predetermined ignition timing operation to deliver a signal shown in FIG. 2 at (f). In the case of the point g for the first cylinder, when an ignition timing control signal ($=V_{cc}$) is applied to the non-inverting input terminal of operational amplifier 41, the output of the operational amplifier 41 changes to a high level as shown in FIG. 2 at (i) because the inverting input terminal of the operational amplifier 41 receives a voltage lower than the voltage of the ignition timing control signal applied to the non-inverting input terminal. Although the application of the ignition timing control signal ceases after that, the voltage (third voltage signal v3) which is obtained by voltage-dividing the output of the operational amplifier 41 by the resistors 58 and 59 appears at the point g. Because the values of the resistors 50–53, and the resistors 58 and 59 are set so that the third voltage signal v3 satisfies the inequality, $v1 > v3 \geqq v2$, the output of the operational amplifier 41 remains high. Although the ignition timing control signal for the second cylinder is inputted to the non-inverting input terminal of the operational amplifier 41 while the output of the operational amplifier is high, no change is made on the output because the output is kept in such high level. This is means that the operational amplifier 41 ignores the ignition timing control signal for the second cylinder. Next, when the first voltage signal v1 is inputted to the inverting input terminal of the operational amplifier 41, the output of the operational amplifier 41 changes to a low level because the third voltage signal v3 is inputted to the non-inverting input terminal of the operational amplifier at that time. As a result, the voltage at the point g becomes 0. The application of the next ignition timing control signal allows the output of the operational amplifier 41 to become the high level again, and output a signal as shown in FIG. 2 at (i). That is to say, the output of the operational amplifier 41 becomes the high level at the timing of the ignition timing control signal for the first cylinder, and it becomes the low level at the timing of the initial ignition signal for the first cylinder.

The output of the operational amplifier is differentiated by the capacitor 43 constituting an ignition timing signal forming means. An ignition timing signal is formed at the timing of the rising of the differentiated waveshape, and is applied to the gate of the thyristor 3, carrying out ignition operation similar to the conventional system.

The operation related to the second cylinder is similar to that related to the first cylinder, and explanation on the operation related to the second cylinder will be omitted for the sake of clarity.

Although the first voltage setting means are constituted by the resistors 50–53, and the resistors 54–57, respectively, in the embodiment, the resistors 51 and 55 are not essential parts. The first voltage setting means can be constructed by using the resistors 50, 52 and 53, and the resistors 54, 56 and 57, which have suitable resistance values.

Although the differentiation capacitors 43 and 45 are used to constitute the ignition timing signal forming means, the ignition timing signal forming means are not limited to such structure. A structure which can form the ignition timing signals at the rising of the output signals from the operational amplifiers 41 and 42 can be adopted to offer advantage similar to the embodiment as described earlier.

Obviously, numerous modifications and variations of the present invention are possible in light of the above teachings. It is therefore to be understood that within the scope of the appended claims, the invention may be practiced otherwise than as specifically described herein.

What is claimed is:

1. An internal combustion ignition timing control system comprising:

ignition signal generating means for generating ignition signals to a plurality of cylinders, respectively;

an ignition timing operating circuit for carrying out a predetermined ignition timing operation based on the ignition signals and delivering ignition timing control signals to the respective cylinders;

a plurality of operational amplifiers arranged to correspond to the respective cylinders;

first voltage setting means connected to the respective operational amplifiers, the first voltage setting means forming a first voltage signal in synchronism with the related ignition signal, and applying the first voltage signal to the inverting input terminal of the operational amplifier, the first voltage setting means forming a second voltage signal indicative of a potential lower than that of the first voltage signal at the absence of the related ignition signal, and applying the second voltage signal to the inverting input terminal;

second voltage setting means connected to the respective operational amplifiers, the second voltage setting means applying to the non-inverting input terminal of the operational amplifier the ignition timing signal outputted from the ignition signal timing operating circuit, the ignition timing signal being indicative of a potential higher than that of the second voltage signal, the second voltage setting means supplying the non inverting input terminal of the operational amplifier with a third voltage signal indicative of a potential lower than that of the first voltage signal and not less than that of the second voltage signal at the absence of the ignition timing control signal; and ignition timing signal forming means connected to the respective operational amplifiers, the ignition timing signal forming means generating an ignition timing signal at the rising of the output signal from the operational amplifiers.

* * * * *